United States Patent [19]

Sato et al.

[11] Patent Number: 4,591,699

[45] Date of Patent: May 27, 1986

[54] CONTROL CIRCUIT FOR AN ELECTRICALLY HEATED BIMETAL ACTUATED AUTOMATIC CHOKE VALVE

[75] Inventors: Yoji Sato, Nagoya; Keiichi Yamamoto, Okazaki, both of Japan

[73] Assignee: Aisan Kogyo Kabushiki Kaisha, Okazaki, Japan

[21] Appl. No.: 614,536

[22] Filed: May 29, 1984

Related U.S. Application Data

[63] Continuation-in-part of Ser. No. 314,786, Oct. 26, 1981, abandoned.

[30] Foreign Application Priority Data

Oct. 31, 1980 [JP] Japan ..... 55-156718

[51] Int. Cl.[4] ..... H05B 1/02

[52] U.S. Cl. ..... 219/497; 219/207; 219/505; 219/492; 219/202; 123/179 B

[58] Field of Search ..... 219/206, 207, 491, 492, 219/497, 499, 501, 209, 505, 504, 202, 203; 123/179 H, 179 B, 179 G

[56] References Cited

U.S. PATENT DOCUMENTS

| | | | |
|---|---|---|---|
| 4,119,835 | 10/1978 | Coulmance et al. | 219/501 |
| 4,278,873 | 7/1981 | Petrides | 219/497 |
| 4,323,763 | 4/1982 | Goldsmith | 219/501 |
| 4,345,141 | 8/1982 | Little | 219/497 |
| 4,347,428 | 8/1982 | Conrad et al. | 219/501 |

FOREIGN PATENT DOCUMENTS

| | | | |
|---|---|---|---|
| 2007877 | 5/1979 | United Kingdom | 219/497 |

*Primary Examiner*—M. H. Paschall

*Attorney, Agent, or Firm*—Dennison, Meserole, Pollack & Scheiner

[57] ABSTRACT

A control circuit for controlling a bimetal actuated choke valve adapted to be driven by a heater energized by electric power whose duty ratio is changed in response to ambient temperature. The control circuit is integrally formed by a hybrid integrated circuit, wherein the characteristics of the duty ratio with respect to the ambient temperature are adjusted by at least one resistance provided externally of the hybrid integrated circuit.

5 Claims, 6 Drawing Figures

CONTROL CIRCUIT FOR AN ELECTRICALLY HEATED BIMETAL ACTUATED AUTOMATIC CHOKE VALVE

This application is a continuation-in-part of application Ser. No. 314,786 filed 10/26/81, now abandoned.

BACKGROUND OF THE INVENTION

1. Field of the Invention

This invention relates to a control circuit for automatically regulating a choke valve in a carburetor for an internal combustion engine, and more particularly, to a control circuit for automatically regulating a bimetal actuated choke valve adapted to be driven by heat from an electric heater.

2. Description of the Prior Art

The prior art automatic choke valve cooperates with a bimetal which is driven by heat from an electrical heater responsive to the ambient temperature. Accordingly, the choke valve is regulated for its open and closed positions by varying the amount of electric power to be supplied to the heater in response to the ambient temperature. To this end, the prior art has proposed the use of a control circuit whereby the duty ratio of electric power is automatically changed. Because of the control circuit being provided in a choke housing incorporated in a carburetor, it is necessary to ensure reliability against changes in temperature and humidity, vibrations, dust and dirt, and all other external circumstances that affect the control circuit. Moreover, such a control circuit should be simple to build and operate because of requirements for ease of handling and for minimizing the number of parts to be assembled.

For example, the prior art, in trying to meet these requirements, has employed a hybrid integrated circuit, which integrates therein all the electronic components, such as constant-voltage circuit, temperature-voltage convertor circuit, oscillator circuit, comparator circuit and switching circuit. Because of this configuration, especially of the temperature-voltage convertor circuit incorporated in the hybrid integrated circuit, the use of the hybrid integrated circuit requires due consideration of the characteristics which vary with the type of choke valves or carburetors. When it is desired to finely adjust the variation characteristics of duty ratio with respect to the ambient temperature, the associated regulating resistance effective to determine the temperature-duty ratio characteristic must be trimmed for adjustment by using a solid laser such as YAG laser. This may lead to increased cost of the overall circuit.

Furthermore, this method of laser-trimming is disadvantageous, because the adjustment of resistance value is limited, and the temperature-duty ratio characteristics may not be adjusted over a wide range.

An object of the present invention is to overcome the aforementioned disadvantages of the prior art.

Another object is to provide a control circuit which is extremely simple to operate without modifying resistances provided in the circuit, and yet effective to regulate the temperature-duty ratio characteristics of the circuit.

A further object is to provide a hybrid integrated circuit which is inexpensive to build, compared with conventional hybrid integrated control circuit wherein resistance is controlled by the method of laser-trimming.

A still further object is to provide a control circuit which may be controlled over a fairly wide range.

It is a specific feature of the present invention that the heater controlling circuit for an automatic choke valve is formed by a hybrid integrated circuit to appropriately control temperature-duty ratio characteristics of the hybrid integrated circuit by means of the external resistances RA and RB, thereby enabling adaptation of the identical control circuit for a control circuit for any automatic choke valves in various types of automobiles which are delicately different from one another, depending upon their engine performances with respect to their control characteristics of the automatic choke valves.

SUMMARY OF THE INVENTION

According to the invention, a control circuit for a bimetal actuated choke valve is integrally formed by a hybrid integrated circuit effective to supply an associated heater with an electric power of which the duty ratio varies with the ambient temperature. Moreover, in such a hybrid integrated circuit, the characteristics of duty ratio with respect to the ambient temperature may be properly controlled by a plurality of resistances provided externally of the hybrid integrated circuit.

Also, according to the present invention, a triangular wave form signal from an oscillator circuit and an output from a temperature-voltage convertor circuit are inputted to a comparator and thereby the duty ratio of a pulse signal outputted from the comparator may be changed in response to the temperature detected by a thermistor. Further, a ramp (a degree of amplification) and a reference voltage to be inputted at the non-inverting terminal of an operational amplifier in the temperature-voltage converter circuit are changed by the external resistances RA and RB, thereby suitably regulating the control characteristics of the automatic choke valve relative to ambient temperature in response to the engine performances of various types of automobiles mounting the automatic choke valves.

DETAILED DESCRIPTION OF THE PREFERRED EMBODIMENT

Figure 1:
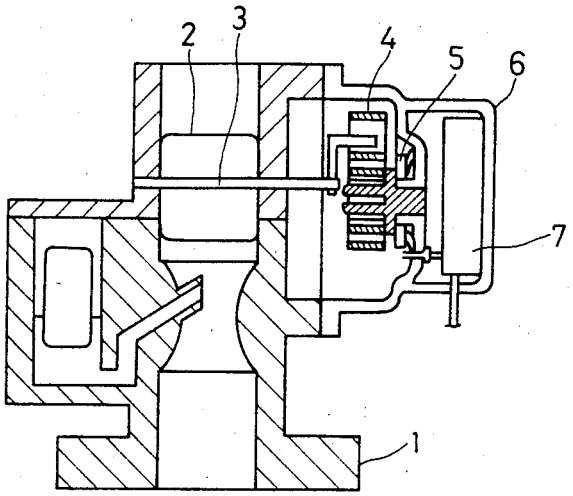
FIG. 1 is a vertical sectional view of a carburetor incorporating one embodiment of the present invention.

Referring now to FIG. 1, shown therein and generally designated by reference numeral 1, is a carburetor body incorporating the features of the present invention. The carburetor body 1 has a well-known choke housing 6 fixedly connected thereto at the upper right-hand portion as viewed in FIG. 1. The choke housing 6 includes a bimetal 4, a heater 5, and a hybrid integrated circuit 7. As is well known, the carburetor body 1 includes a choke valve 2 disposed in the gas passage thereof and rotatably carried by a driving shaft 3, one end of which being operatively connected to the bimetal 4 which pivots under heat from the heater 5 according to the conventional technique. The heater 5 is connected to an output terminal of the hybrid integrated circuit 7 disposed in the choke housing 6.

Figure 2:
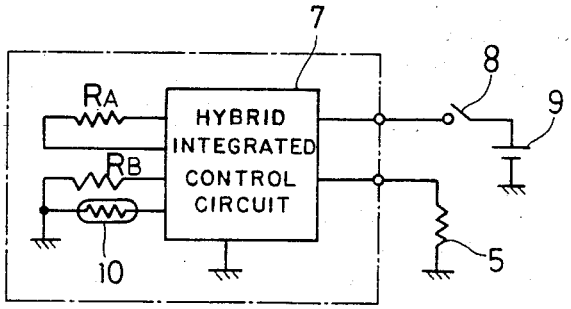
FIG. 2 is a schematic diagram of the electrical circuit of the invention.

Attention is now directed to FIG. 2 which illustrates an electrical circuit of the invention.

The input terminal of the hybrid integrated circuit 7 is connected through an ignition switch 8 to a battery 9, while the output terminal thereof is connected to the heater 5, as discussed in the preceding paragraphs. Further, connected electrically to the hybrid control circuit 7 are resistances RA and RB both for regulating temperature-duty ratio characteristics, and a temperature sensor or thermistor 10. As generally illustrated, both terminals of the resistance RA, one terminal of the resistance RB and one terminal of the thermistor 10 are connected to the hybrid integrated circuit 7. The other terminals of the resistance RB and the thermistor 10 are grounded.

A specific inventive feature of the present invention is that the heater controlling circuit for an automatic choke valve is formed by a hybrid integrated circuit to automatically control a ratio of on-time and off-time in response to ambient temperature upon on-off control of power source to be supplied to said heater and also to appropriately adjust said ratio by means of the external resistance RA and RB, thereby enabling adaptation of the identical control circuit for a control circuit for any automatic choke valves in various types of automobiles which are delicately different from one another, depending upon their engine performances with respect to their control characteristics of the automatic choke valves.

Figure 3:
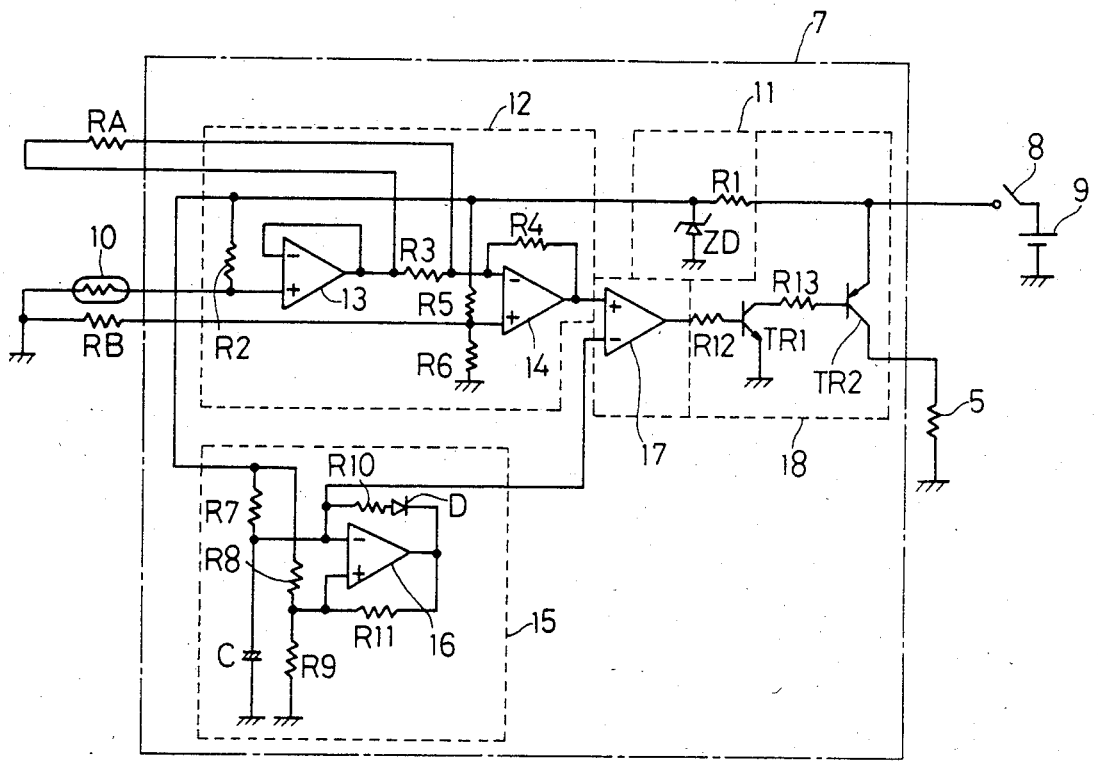
FIG. 3 is a schematic diagram illustrating in detail the electrical circuit of the hybrid integrated circuit according to the present invention.

FIG. 3 shows in detail a schematic diagram of the hybrid integrated circuit 7. Reference numeral 11 is a constant-voltage circuit consisting of a resistance R1 and a zener diode ZD. Connected electrically to the constant-voltage circuit 11 is a temperature-voltage convertor circuit 12 consisting of operational amplifiers 13 and 14 and resistances R2 through R6. The thermistor 10 is connected to the positive terminal of the operational amplifier 13 to which is inputted a voltage response to variations in resistance indicative of the ambient temperature. The inputted voltage is amplified in the amplifier 13 and then fed to the negative terminal of the operational amplifier 14 through the resistance R3. The resistance RA for regulating the input voltage just described is connected in parallel with the resistance R3. Additionally, the resistance RB for regulating the characteristic of the output voltage of the amplifier 14 is connected in parallel with the resistance R6 connected to the positive terminal of the amplifier 14. With this configuration, the output voltage of the amplifier 14 will be determined by the values of resistances RA and RB as well as the values of resistances R3 through R6.

Reference numeral 15 is an oscillator circuit which generates ramp or triangular wave signals having a constant frequency T. The oscillator circuit 15 consists of an operational amplifier 16, resistances R7 through R11, a capacitor C and a diode D.

According to the present invention, a triangular wave form signal from the oscillator circuit 15 and an output from the temperature-voltage convertor circuit 12 are inputted to the comparator 17, and thereby the duty ratio of a pulse signal outputted from the comparator 17 may be changed in response to the temperature detected by the thermistor 10. Further, a ramp (a degree of amplification) and a reference voltage to be inputted at the non-inverting terminal of the operational amplifier 14 in the temperature-voltage convertor circuit 12 are changed by the external resistances RA and RB, thereby suitably regulating the control characteristics of the automatic choke valve relative to ambient temperature in response to the engine performances of various types of automobiles mounting the automatic choke valves.

The above-mentioned operation may be represented by the following equations:

$$V_0 = (V_I - V_{REF})\frac{R4(R3 + RA)}{R3 \cdot RA} \quad (1)$$

$$V_{REF} = V_B \frac{\frac{R6 \cdot RB}{R6 + RB}}{\frac{R6 \cdot RB}{R6 + RB} + R5} \quad (2)$$

Wherein, $V_{REF}$ is a voltage at the non-inverting terminal (+) of the operational amplifier 14, and $V_I$ is an input voltage of the inverting terminal (−) and $V_O$ is an output voltage of the operational amplifier 14, and $V_B$ is a voltage of the battery 9.

As will be apparent from the equation (1), the characteristics of the output voltage $V_O$ of the operational amplifier 14 may be changed as shown in FIG. 5*a* by changing the external resistance RA, and as will be also apparent from the equation (2), the characteristics of the output voltage $V_O$ of the operational amplifier 14 may be changed as shown in FIG. 5*b* by changing the external resistance RB .

Reference numeral 17 is a comparator which, upon reception of both input voltages from the temperature-voltage convertor circuit 12 and the oscillator circuit 15, generates an output voltage having duty ratio responsive to changes in ambient temperature. As generally seen, the output of the oscillator circuit 15 is connected to a negative terminal of the comparator 17, and the output of the temperature-voltage converter circuit 12 is connected to the positive terminal of the comparator 17. The output of the comparator 17 is then inputted to a switching circuit 18 which consists of transistors TR1 and TR2 and resistances R12 and R13. The output of the comparator 17 is connected to the base of the transistor TR1 through the resistance 12. The emitter thereof is grounded and the collector thereof is connected to the base of the transistor TR2 through the resistance R13. The emitter of the transistor TR2 is connected through the ignition switch 8 to the battery 9, and the collector thereof is connected to the heater 5.

Figure 4:
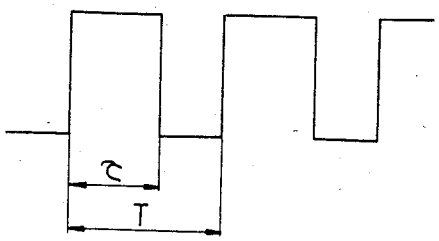
FIG. 4 is a chart illustrating the duty ratio of the inventive circuit.

With this configuration, when the ignition switch 8 is turned on to start the engine, the oscillator circuit 15 will supply the comparator 17 with a pulse signal having a constant frequency T as generally shown in FIG. 4. During the operation, the temperature-voltage convertor circuit 12 will output a voltage indicative of the ambient temperature sensed by the thermistor 10. The output voltage is then supplied to the comparator 17 which in turn will output a pulse signal for $\tau$ time in response to the voltage. The transistors TR1 and TR2 of the switching circuit 18 are then turned on by the pulse signal so as to energize the heater 5. The bimetal 4 is then driven by heat from the heater 5 to thereby open the choke valve 2. It should be noted that energization of the heater 5 will last only for $\tau$ time determined by the pulse signal from the comparator 17, and thus a power of duty ratio $=\tau/T\times 100$ (%) will be supplied to the heater 5.

Figure 5:
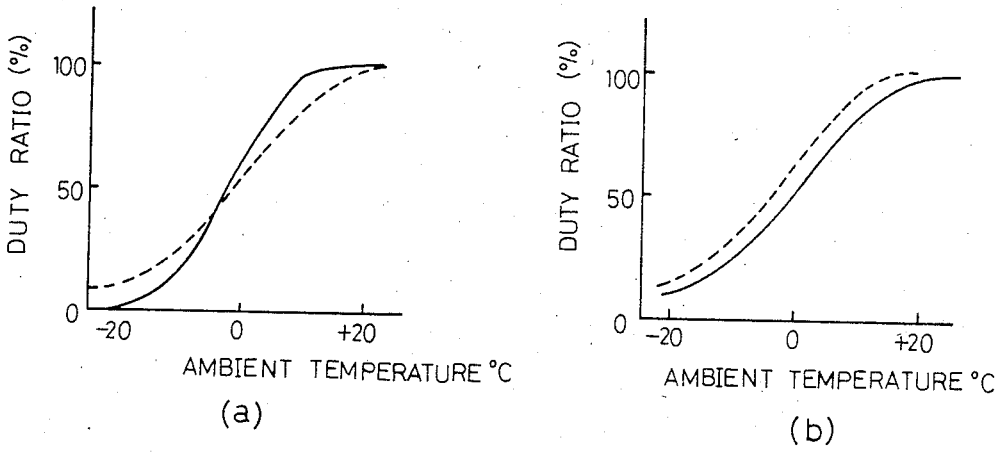
FIG. 5 is a graph illustrating the characteristic of duty ratio with respect to ambient temperature.

Attention is now directed to FIG. 5 which illustrates the characteristics of duty ratio with respect to the ambient temperature sensed by the thermistor 10. As may be seen, FIG. 5 shows types of duty ratio of electric power to be supplied to the heater 5 in accordance with the characteristics of output voltage of the temperature-voltage convertor circuit 12 which is indicative of the ambient temperature. It will be appreciated from FIG. 5(*a*) that the characteristic (shown by a solid line) determined by resistances R3 through R6 in the hybrid integrated circuit 7 may be adjusted to a characteristic shown by a phantom line by increasing the value of the resistance RA alone. By the same token, it will be appreciated from FIG. 5(*b*) that the characteristic according to the increased value of the resistance RA may be adjusted to a characteristic shown by a phantom line by increasing the value of the resistance RB alone. Thus, the characteristic of duty ratio with respect to the ambient temperature may be adjusted readily in a wide range in accordance with the characteristics of choke valves or temperature sensors.

As is described above, the present invention may automatically control the heater for heating the bimetal adapted to open and close the choke valve in response to ambient temperature regardless of change in ambient temperature, and may control any choke valves used in many different types of automobiles by adjusting the external resistances with the integrated control circuit.

Figure 6:
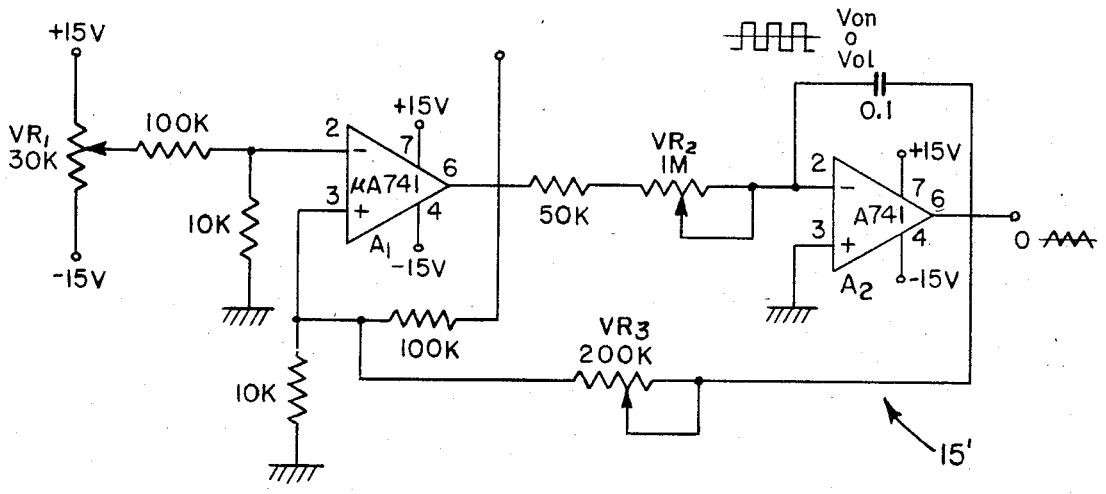
FIG. 6 is a schematic diagram illustrating another embodiment of oscillator usable in the hybrid integrated circuit of FIG. 3.

FIG. 6 is a schematic diagram of another triangular wave oscillator circuit 15' usable in practicing the present invention, extracted from "Practical Electronic Circuit Handbook" published by CQ Publishing Company, in Japanese in 1972, pages 456 to 457.

What is claimed is:

1. A hybrid control circuit for a bimetal actuated automatic choke valve adapted to be operated by a heater comprising a temperature-voltage convertor circuit including first operational amplifier means for generating a first output voltage corresponding to an ambient temperature detected by a thermosensor, and second operational amplifier means for generating a second reference output voltage, said second reference output voltage being effected by two external interchangeable resistances, an oscillator circuit for generating a triangular pulse signal having a fixed period, a comparator for comparatively receiving the respective outputs from said temperature-voltage convertor circuit and said oscillator circuit, and a switching circuit for on-off control of said heater according to the output from said comparator, thus allowing choke valve operation to be tailored to various specific engine designs without necessitating replacement of the complete hybrid control circuit.

2. The control circuit as defined in claim 1 wherein said temperature-voltage convertor circuit includes a first operational amplifier, to which an output from said thermosensor is applied, and further comprising an external interchangeable resistance RA connected to one of the input terminals of said second operational amplifier, said external interchangeable resistance RA serving to change a degree of amplification of said output from said theromsensor and another external interchangeable resistance RB connected to the other of the input terminal of said second operational amplifier, said external interchangeable resistance RB serving to change a voltage at said other input terminal.

3. The control circuit as defined in claim 1 wherein said thermosensor is a thermistor.

4. A hybrid control circuit for a bimetal actuated automatic choke valve adapted to be operated by a heater comprising:

a temperature-voltage convertor circuit including two operational amplifier means for generating an output voltage corresponding to an ambient temperature to be detected by a thermosensor circuit;

a first external interchangeable resistance connected to said temperature-voltage convertor circuit for altering an input voltage to the non-inverting input of the second of said two operational amplifier means of said temperature-voltage convertor circuit;

a thermistor for sensing ambient temperature connected to the non-inverting input of the first of said two operational amplifier means of said temperature-voltage convertor circuit;

a second external interchangeable resistance connected to said temperature-voltage convertor circuit for changing a reference voltage to be supplied to the inverting input of the second of said two operational amplifier means of said temperature-voltage convertor circuit;

an oscillator circuit for generating a triangular wave form signal having a fixed period;

a comparator for receiving the respective outputs from said temperature-voltage convertor circuit and said oscillator circuit and for outputting a switching pulse signal; and a switching circuit for receiving said switching pulse signal from said comparator and for controlling a power supply for heating of said heater.

5. The control circuit as defined in claim 4 wherein said thermosensor is a thermistor.

* * * * *